US006089875A

United States Patent [19]

Iwata et al.

[11] Patent Number: 6,089,875

[45] Date of Patent: Jul. 18, 2000

[54] SLIP RING ASSEMBLY AND THE MANUFACTURING METHOD THEREOF

[75] Inventors: Kiyohide Iwata; Haruo Atsumi, both of Shizuoka, Japan

[73] Assignee: Star Micronics Co., Ltd., Shizouka, Japan

[21] Appl. No.: 09/313,357

[22] Filed: May 18, 1999

[30] Foreign Application Priority Data

May 18, 1998 [JP] Japan ..... 10-135313

[51] Int. Cl.[7] ..... H01R 39/00

[52] U.S. Cl. ..... 439/26; 439/23

[58] Field of Search ..... 439/26, 24, 25, 439/23, 21, 18; 310/232, 248, 249

[56] References Cited

U.S. PATENT DOCUMENTS

Re. 32,805 12/1988 Engelmore et al. ..... 439/26

3,599,165 8/1971 Wendell et al. ..... 191/12

4,326,769 4/1982 Dorsey et al. .

5,435,731 7/1995 Kang ..... 439/26

5,846,090 12/1998 Lu ..... 439/26

FOREIGN PATENT DOCUMENTS 55-159581 12/1980 Japan ..... H01R 39/08

*Primary Examiner*—Lincoln Donovan

*Assistant Examiner*—Chandrika Prasad

*Attorney, Agent, or Firm*—Sughrue, Mion, Zinn, Macpeak & Seas, PLLC

[57] ABSTRACT

A slip ring assembly comprising a fixed base unit and a rotor unit. The fixed base unit has a fixed base, a plurality of electrode plates detachably attached to a plurality of slits formed on the fixed base, and a brush fixed on each of the electrode plates. The rotor unit has a rotor shaft, a plurality of conductive rings and insulation spacers alternately placed on top of each other on the outer periphery of the rotor shaft in a detachable state so that each of the conductive rinds is positioned to correspond to each brush.

9 Claims, 8 Drawing Sheets

SLIP RING ASSEMBLY AND THE MANUFACTURING METHOD THEREOF

BACKGROUND OF THE INVENTION

1. Field of the Invention

The present invention relates to a slip ring assembly for supplying electric signal and electric power to a rotative body incorporated in various instruments, and to the manufacturing method thereof. More particularly, the present invention relates to those in which a simplified assembly procedure, reduced defect occurrence rate and lower production cost are accomplished.

2. Description of the Related Art

There are several examples of slip ring assembly in the prior art, such as the Japanese non-examined publication (Kokai) No. Sho 55-159581, U.S. Pat. No. 3,599,165, and also U.S. Pat. No. 4,326,769.

The slip ring assembly as disclosed above typically comprises two sections of elements, that is, a fixed base unit mounted on any instrument incorporating a rotative body, and a rotor unit rotatively accommodated in the fixed base unit and electrically connected to the rotative body via a plurality of lead wires.

The fixed base unit has a plurality of brushes connected to the lead wires, and the rotor unit similarly has a conductive ring connected to the lead wires. With this structure, when the rotor unit rotates, the brushes on the side of the fixed base unit are constantly in contact with the conductive ring, thereby the electric power and the signal can be supplied to the rotative body.

The structure of the fixed base unit and the rotor unit is described below, in particular to the production method thereof. First, as for the fixed base unit, the brushes to which the lead wires are connected are placed inside the insert-injection mold into which the heat-setting resin is injected, so that the fixed base unit integrally incorporating a plurality of brushes may be obtained. In this connection, since the brushes may be distorted during insert molding, the correction of the brushes should be carried out after completion of insert molding in order to adjust the contact pressure to the conductive ring.

As for the rotor unit, the conductive ring to which the lead wires are connected is then placed inside the insert mold, and the heat-setting resin is injected into the mold. Thus the rotor unit integrally incorporating the conductive ring is obtained. Then the conductive ring is exposed by lathe working. This lathe working should be carried out since the resin has covered the surface of the conductive ring (the contact surface with the brush) when the rotor unit is molded. In addition, the gold-plating is applied thereto after the lathe working in order to obtain the stable conduction.

Then the rotor unit is placed and accommodated in the fixed base unit, then a desired slip ring assembly is obtained by adding various arrangements accompanied thereto. The slip ring assembly is then attached to any instrument, and the plurality of lead wires are connected to the rotative body of the instrument. Accordingly, when the rotative body rotates, the rotor unit also rotates in a state that the necessary electric power can be supplied to the rotative body without the plurality of lead wires being twisted, thereby the signal communication between the rotative body can be accomplished.

However, the above prior arts have the following disadvantages.

First, since the rotor unit has been produced by insert molding, when there is a conduction defect in regard to any one of the plurality of the conductive parts (i.e. conductive ring), the whole unit of the rotor should be replaced. This means the overall abandonment of the rotor unit in spite of existence of the minimum part of the defective conduction, which might lead to the rise in maintenance cost. This problem becomes more serious when the number of the conductive rings increases.

This may also be applied to the case of the fixed base unit. That is, when there is a conduction defect in regard to any one of the plurality of the conductive parts (i.e. brushes), the whole body of the fixed base unit should be abandoned and replaced to a new, whole fixed base unit.

Further, in regard to the gold-plating for the rotor unit, such a gold-plating should be carried out after completion of the insert molding as well as the lathe working (that is, in a complete state as a rotor unit). According to the ordinary method of plating, the object to be plated should be soaked in the plating bath, and in this case, since the whole rotor unit must be soaked, any other parts not subject to be plated (i.e. parts except the conductive rings) should also be soaked in the plating bath. Consequently, the number possible to be plated at one time is seriously reduced, which might result in the increase of the plating cost.

In addition, as above discussed, since the brushes may be distorted due to molding pressure of the insert molding, the form of the brushes should be corrected after completion of the molding, which might also result in the increase of the production cost.

It also should be noted that, since the rotor unit and the fixed base unit should be produced by insert molding, it is necessary to use any material having strong coating effect against high temperature (e.g. "Teflon" coated material) for the lead wires, connected to the conductive ring and the brushes, by soldering (welding). Consequently, the higher manufacturing cost should be incurred.

It should also be noted that, each time when the slip ring assembly having a different number of electrodes is produced, it is necessary to prepare the specialized inserting molds used only for such a rotor unit as well as for such a fixed base unit. Accordingly, it is impossible to prepare a common mold which can be used for various types of slip ring assembly having different number of electrodes, thus the cost therefor becomes considerably high.

SUMMARY OF THE INVENTION

It is an object of the present invention to provide a slip ring assembly and the manufacturing method thereof, in which a plurality of conductive parts of a fixed base unit and a rotor unit may independently be detached. Accordingly, the slip ring assembly and the manufacturing method thereof may contribute to the good workability, reduced defect occurrence rate, and the cost-effectiveness.

To achieve the object mentioned above, according to claim 1 of the present invention, there is provided a slip ring assembly comprising a fixed base unit, which is further comprising, a fixed base, a plurality of electrode plates detachably attached to a plurality of slits formed on the fixed base, and each of the electrode plates having a brush fixed thereon. A rotor unit rotatably accommodated inside the fixed base unit comprising, a rotor shaft, and a plurality of conductive rings and insulation spacers alternately placed on top of each other on the outer periphery of the rotor shaft in a detachable state. Each of said conductive rings is positioned to correspond to the brush of each of the electrode plates.

According to claim 2, there is provided the slip ring assembly as claimed in claim 1, wherein the rotor shaft is provided with a guide mechanism at the outer periphery thereof, the conductive rings and the insulation spacers being alternately placed on top of each other so that a circumferential position of each of the conductive rings and the insulation spacers is determined by the guide mechanism.

According to claim 3, there is provided the slip ring assembly as claimed in claim 2, wherein the guide mechanism comprising, a pair of grooves elongated and extended in an axial direction of the rotor shaft, and a pair of guide bars respectively engaged with the pair of grooves, and a recessed portions formed on each of the conductive rings and the insulation spacers for engaging with the pair of guide bars.

According to claim 4, there is provided the slip ring assembly as claimed in claim 3, wherein each of the pair of guide bars is provided with first protrusion which engages with each of the pair of grooves formed on the rotor shaft, and with second protrusion opposite to the first protrusion engaged with each of the recessed portions formed on each of the conductive rings and the insulation spacers.

According to claim 5, there is provided the slip ring assembly as claimed in claim 1, wherein the brush is substantially formed in a shape of letter "U" and is nipped and fixed by folding a portion of the electrode plate.

According to claim 6, there is provided the slip ring assembly as claimed in claim 5, wherein each end of the brush becomes wider in the outward direction.

According to claim 7, there is provided the slip ring assembly as claimed in any one of claims 1 to 6, wherein the slip ring assembly is used for a security camera.

Further, according to claim 8, there is provided a slip ring assembly manufacturing method, comprising a step of alternately placing a plurality of conductive rings and insulation spacers on top of each other in a detachable state on an outer periphery of a rotor shaft, thereby forming a rotor unit, a step of detachably attaching a plurality of electrode plates each provided with a brush, respectively to a plurality of slits formed on a fixed base so that each brush may correspond to each of the conductive rings thereby forming a fixed base unit, and a step of accommodating the rotor unit in the fixed base unit so that each brush may be in contact with each of the conductive rings.

According to claim 9, there is provided the slip ring assembly manufacturing method as claimed in claim 8, further comprising a step of plating being applied to the conductive rings in advance.

Accordingly, in regard to the fixed base unit, the plurality of electrode plates having brushes respectively are detachably attached to the slits of the fixed base, and in regard to the rotor unit, a plurality of the conductive rings and insulation spacers, both of which have been produced independently, are alternately detachably placed on top of each other on the outer periphery of the rotor shaft.

With this structure, when there is any conduction or insulation defect at any portion of the fixed base unit or the rotor unit, it is sufficient to replace only the corresponding defective electrode plate, conductive ring or the insulation spacer, thus the replacement of the whole unit is no longer required.

When the guide mechanism is provided on the outer periphery of the rotor unit, the piling process of the conductive rings and the insulation spacers will be facilitated, and the accurate positioning of the conductive rings and the insulation spacers may also be accomplished.

There will be various structures of the guide mechanism, and one example thereof may be that a pair of the grooves are formed on the rotor shaft with which a pair of guide bars are engaged, so that the pair of guide bars guide the conductive rings and the insulation spacers.

There will also be various structures of the brush and the electrode plate, and one example thereof may be that the substantial shape of the brush is the letter of "U" and is nipped and held by the bending portion provided on the electrode plate being folded.

The brush may preferably be in a shape that each end thereof becomes wider in the outward direction.

There will be various usage of the slip ring assembly, and one example thereof may be that used for a security camera having a rotative structure.

Claim 8 relates to the manufacturing method of the slip ring assembly. First, the conductive rings and the insulation spacers are alternately placed on top of each other on the outer periphery of the rotor shaft in a detachable state in order to obtain the rotor unit. At the same time, or before or after preparing of this rotor unit, the electrode plate having the brush is attached to each slit of the fixed base in a detachable state in order to obtain the fixed base unit. The slits of the fixed base have the structure so that each of the brushes corresponds to each of the conductive rings. Then the rotor unit is incorporated in the fixed base unit so that each of the brushes may be in contact with each of the conductive rings. Thus the desired slip ring assembly is obtained.

At that time, the conductive rings may preferably be gold-plated in advance.

Accordingly, in regard to the fixed base unit, a plurality of the electrode plates having brushes respectively are detachably attached to the slits of the fixed base, and in regard to the rotor unit, the conductive rings and insulation spacers are alternately placed on top of each other on the outer periphery of the rotor shaft in a detachable state. Thus, when there is any conduction or insulation defect, the replacement of the unit as a whole is not required, and instead, it is sufficient to replace only the defective part, that is the electrode plate, the conductive ring or the insulation spacer, therefore the lower percent defective, cost reduction, facilitated assembly working may be accomplished.

Further, when the guide mechanism is provided on the outer periphery of the rotor shaft, the plurality of the conductive rings and the insulation spacers may accurately and easily be assembled by using this guide mechanism.

Further, according to the manufacturing method of slip ring assembly according to the present invention, the facile manufacturing with lower manufacturing cost may be accomplished.

BRIEF DESCRIPTION OF THE DRAWINGS

The invention will be described below in detail with reference to the accompanying drawings, in which.

DETAILED DESCRIPTION OF THE INVENTION

Figure 1:
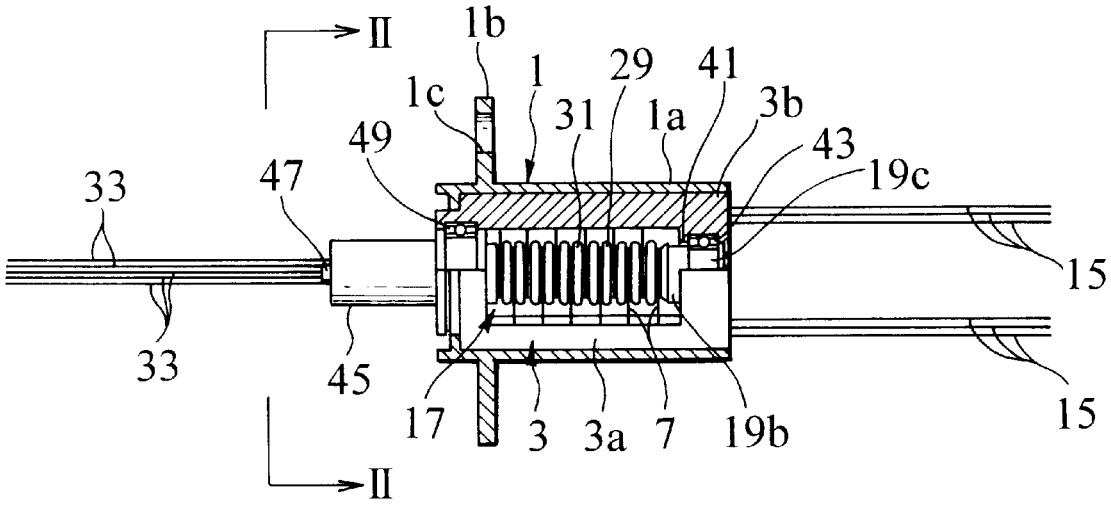
FIG. 1 is a sectional view of a slip ring assembly according to an embodiment of the present invention.
Figure 2:
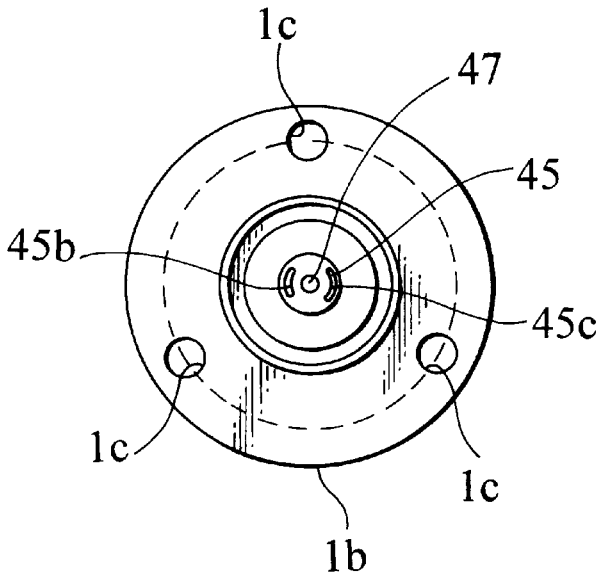
FIG. 2 is a view as viewed from an arrow II—II of FIG. 1 according to the embodiment of the present invention.

An embodiment of the present invention will now be described with reference to FIGS. 1 through 23. FIGS. 1 and 2 show overall structure of a slip ring assembly according to the present invention. There is a case 1, which comprises a hollow-cylindrical shape of a case body 1*a* and a flange 1*b* provided on the left hand of the case body 1*a* as seen in FIG. 1. The flange 1*b* has a plurality of holes 1*c* (in the present embodiment, three holes as shown in FIG. 2) into each of which an unillustrated bolt may be penetrated. The slip ring assembly according to the present invention is mounted to an arbitrary instrument, for example a security camera, via the case 1.

The detailed state of the instrument incorporating the present invention will be described afterwards (see FIG. 23).

The case 1 accommodates a fixed base unit 3 therein. As illustrated in FIGS. 5 through 9, the fixed base unit 3 may be divided into two parts, namely a pair of fixed base elements 3*a* and 3*b*. As also shown in FIGS. 5 through 9, the fixed base element 3*a* has a substantial semicircular shape with a hollow at the center (i.e. semicircular tubular shape), and is provided with a plurality of slits 5 at a regular pitch. A plurality of electrode plates 9 respectively having a brush 7 are inserted from the outer side of the slits 5 into the inner side thereof, thus the brushes 7 as well as the electrode plates 9 are pressed and fixed on the fixed base unit 3.

Figure 10:
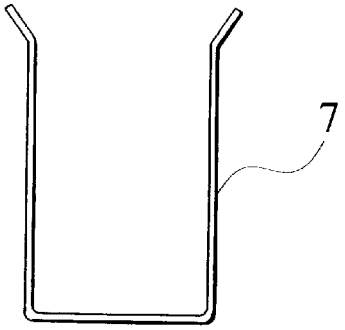
FIG. 10 is a front view of a brush according to the embodiment of the present invention.
Figure 11:
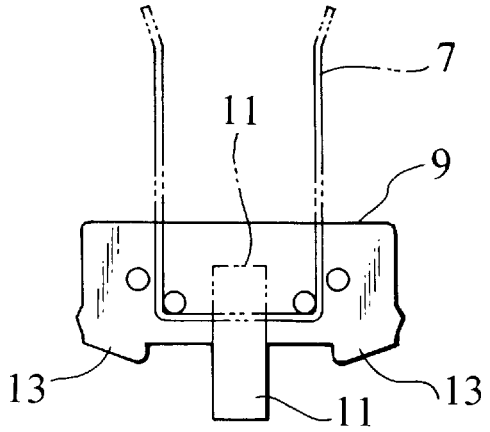
FIG. 11 is a front view of an electrode plate according to the embodiment of the present invention.

As illustrated in FIG. 10, the brush 7 substantially has a shape of letter "U," each of which end extending to become wider. The brush 7 is made of conductive material such as metal, and serves as an elastic brush by which certain contact pressure may be applied to the counterpart. The electrode plate having the brush 7 mounted is inserted into the slit 5 of the fixed base unit element 3*a* from the outer side, thus the brush 7 as well as the electrode plate 9 are pressed and fixed on the fixed base unit 3. As shown in FIG. 11, the electrode plate 9 is provided with a foldable tip 11. The brush 7 (shown by virtual lines in FIG. 11) is placed on the electrode plate 9, then the foldable tip 11 is folded upward of FIG. 11, thereby the brush 7 is fixed on the electrode plate 9. The folded state of foldable tip 11 is also illustrated by virtual line in FIG. 11.

Figure 5:
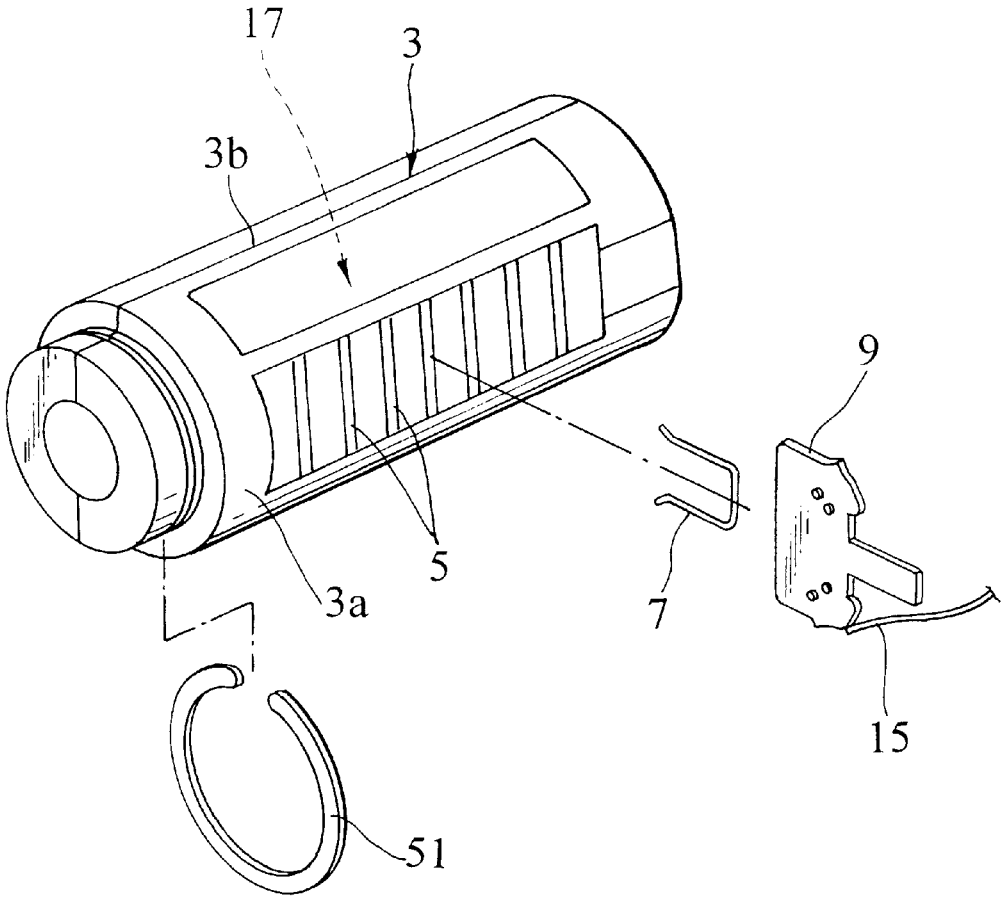
FIG. 5 is a perspective view showing a structure of a fixed base unit according to the embodiment of the present invention.
Figure 6:
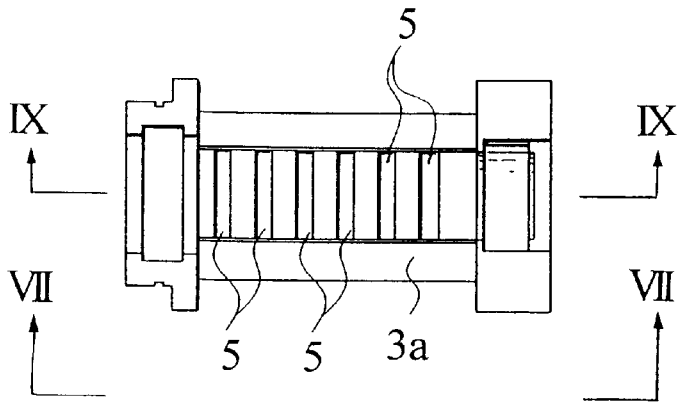
FIG. 6 is a plan view of a fixed base element according to the embodiment of the present invention.
Figure 7:
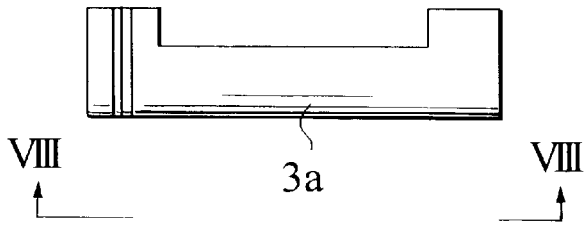
FIG. 7 is a view as viewed from an arrow VII—VII of FIG. 6 according to the embodiment of the present invention.
Figure 8:
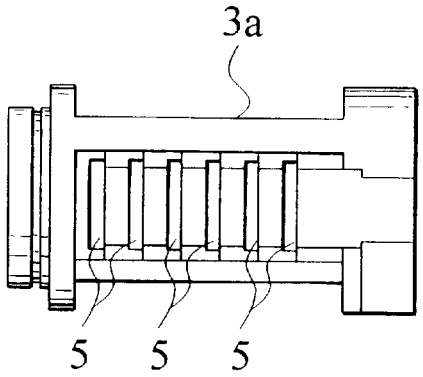
FIG. 8 is a view as viewed from an arrow VIII—VIII of FIG. 7 according to the embodiment of the present invention.
Figure 9:
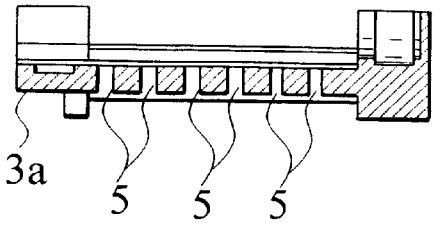
FIG. 9 is a sectional view being cut by an arrow IX—IX of FIG. 6 according to the embodiment of the present invention.

Further, engagement parts 13, 13 are respectively formed at the lower ends of the electrode plate 9, on the left and right. The engagement parts 13, 13 are respectively engaged with the right and left ends of the slit 5, thus the position of the electrode plate 9 holding the brush 7 is determined. Then, as shown in FIGS. 1 and 5, lead wire 15 is connected to each electrode plate 9.

The structure of the other fixed base unit element 3*b* is essentially similar to the fixed base unit element 3*a*, except for the offset position of the slit 5 in the axial direction. This offset positioning is due to the fact that the brushes 7 should alternately be inserted into a rotor unit (which will be discussed in detail afterwards) from each of the pair of fixed base unit elements 3*a* and 3*b*.

As above discussed, the fixed base unit 3 has the pair of the fixed base element units 3*a* and 3*b*, into which the plurality of electrode plates 9 respectively having the brush 7 are pressed and fixed, in a detachable state. According to this structure, for example, when the conduction defect occurs to any of the brushes 7, it is possible to detach the electrode plate 9 corresponding to such a defective brush 7 so that only this part can be replaced to the new one. Accordingly, it is not necessary to replace the fixed base unit 3 as a whole.

Figure 3:
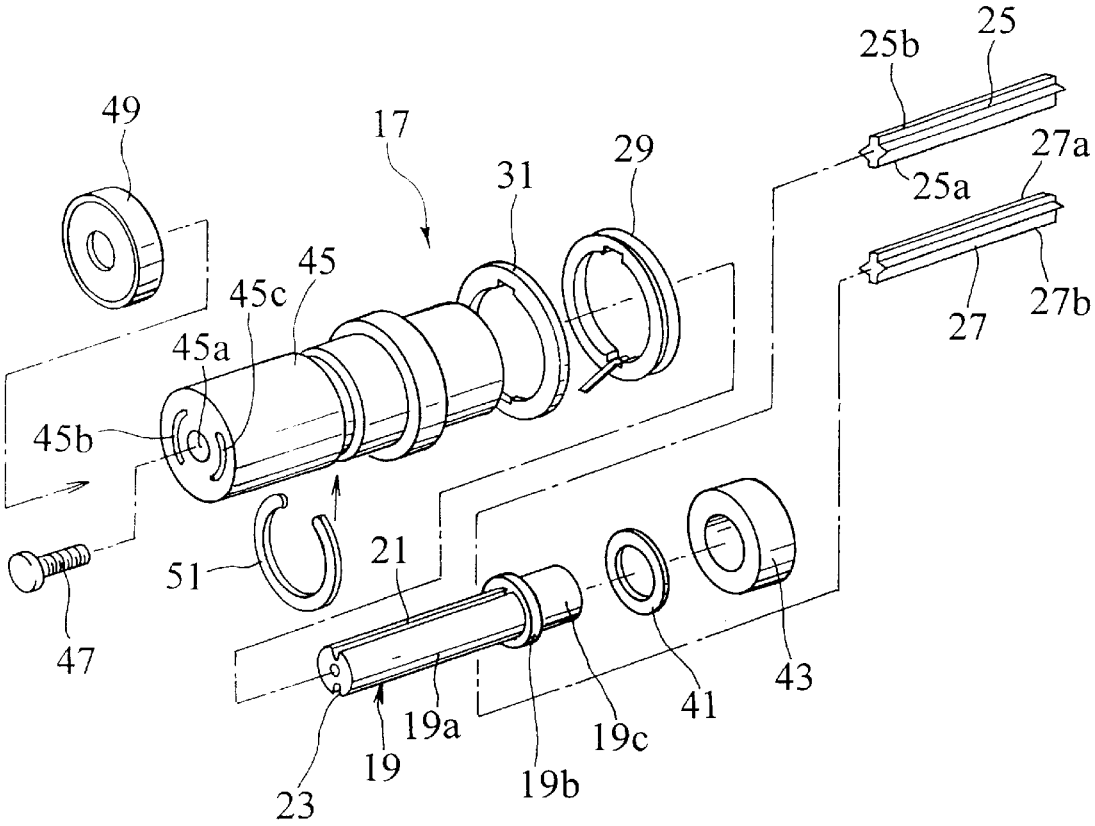
FIG. 3 is an exploded perspective view showing a structure with a case removed according to the embodiment of the present invention.
Figure 4:
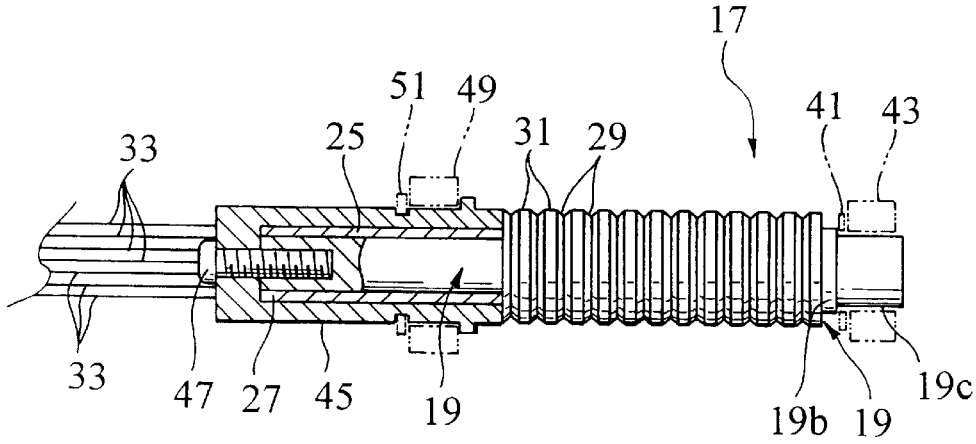
FIG. 4 is a side view showing a structure of a rotor unit partially cut off according to the embodiment of the present invention.

There is a rotor unit 17 accommodated in the fixed base unit 3. The structure of the rotor unit 17 is as illustrated in FIGS. 3 through 5. FIG. 3 is an exploded perspective view of the rotor unit 17, FIG. 4 is a side view thereof, and FIG. 5 is a perspective view is which the rotor unit 17 is covered by the fixed base unit 3.

Figure 12:
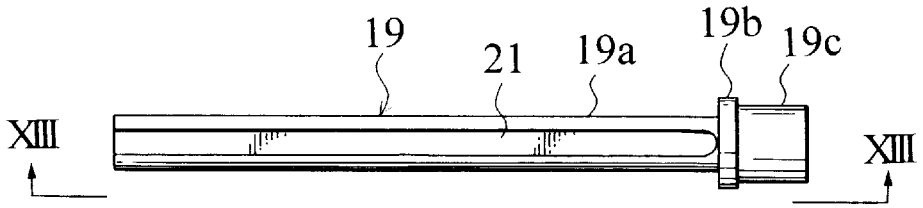
FIG. 12 is a plan view of a rotor shaft according to the embodiment of the present invention.
Figure 13:
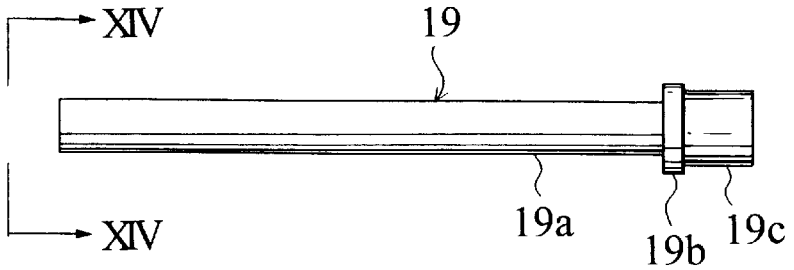
FIG. 13 is a view as viewed from an arrow XIII—XIII of FIG. 12 according to the embodiment of the present invention.
Figure 14:
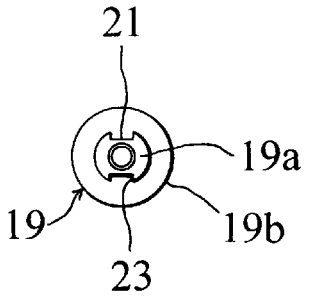
FIG. 14 is a view as viewed from an arrow XIV—XIV of FIG. 13 according to the embodiment of the present invention.

The rotor unit 17 has a rotor shaft 19. As illustrated in FIGS. 12 through 14, this rotor shaft 19 comprises a shaft body 19*a*, a flange 19*b* formed on the right hand of the FIG. 19*a* in FIG. 12, and another shaft body 19*c* formed on the right hand of the flange 19*b* in FIG. 12.

Figure 15:
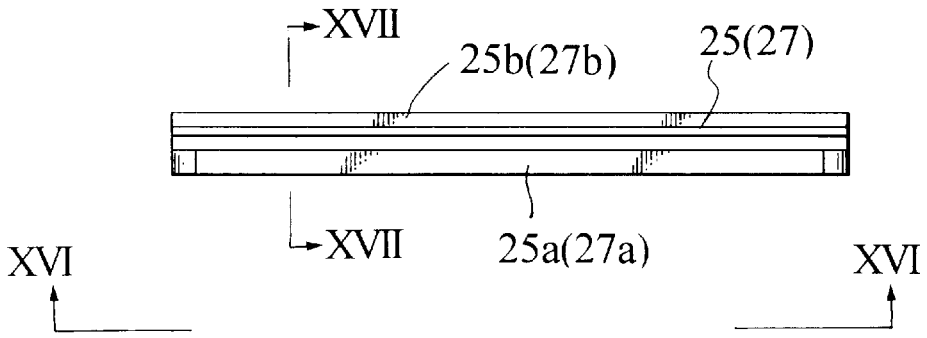
FIG. 15 is a side view of a guide bar according to the embodiment of the present invention.
Figure 16:
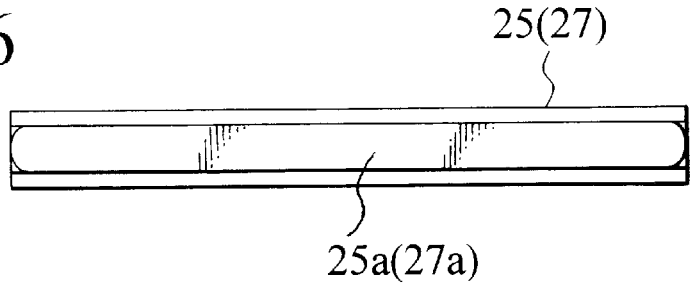
FIG. 16 is a view as viewed from an arrow XVI—XVI of FIG. 15 according to the embodiment of the present invention.
Figure 17:
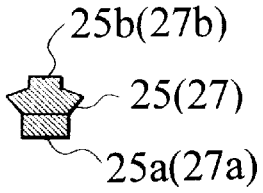
FIG. 17 is a view as viewed from an arrow XVII—XVII of FIG. 15 according to the embodiment of the present invention.

As seen from FIG. 14, the shaft body 19*a* has a pair of grooves 21, 23 elongated along the direction of the shaft so that each groove may be separated by maintaining the angle of 180° (that is, by maintaining the absolute opposite position to each other). Each of the grooves 21, 23 is engaged with the corresponding one of a pair of guide bars 25, 27, of which shape is as illustrated in FIGS. 15 through 17. In particular, as shown in FIG. 17, one side of the guide bar 25 (27) has a protrusive strip 25*a* (27*a*) to be engaged with the above-mentioned groove 21 (23), and the other side of the guide bar 25 (27) has a key 25*b* (27*b*). With this structure, conductive rings 29 and insulation spacers 31 are placed on top of each other on the outer surface of the guide bars 25, 27.

Figure 18:
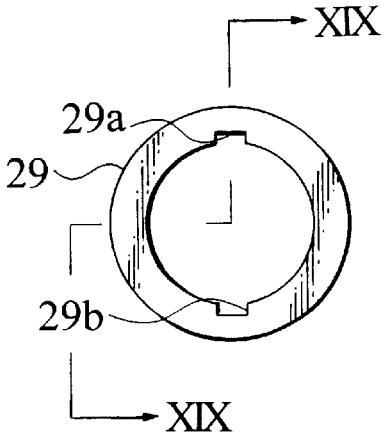
FIG. 18 is a front view of a conductive ring according to the embodiment of the present invention.
Figure 19:
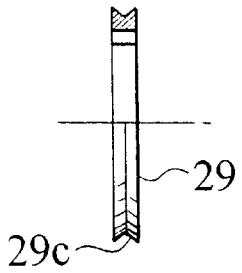
FIG. 19 is a sectional view being cut by an arrow XIX—XIX of FIG. 18 according to the embodiment of the present invention.

The structure of the conductive ring 29 is illustrated in FIGS. 18 and 19. As illustrated in FIG. 18, there is provided a pair of key grooves 29*a*, 29*b* absolutely opposite to each other (that is, at an angle of 180°), which correspond to the pair of keys 25*b*, 27*b* of the guide bars 25, 27. Thus the conductive rings 29 may be installed pursuant to the predetermined positioning structure according to the relation between the key and the key groove ("key/key-groove structure"). Further, as illustrated in FIG. 19, there is a v-groove 29*c* on the outer cylindrical surface of the conductive ring 29, so that this v-groove 29*c* may be pressed by and also engaged with the brush 7.

Figure 21:
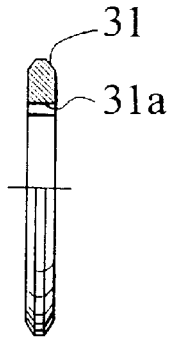
FIG. 21 is a sectional view being cut by an arrow XXI—XXI of FIG. 20 according to the embodiment of the present invention.
Figure 20:
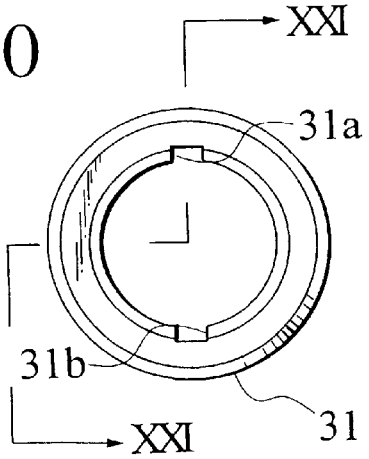
FIG. 20 is a front view of an insulation spacer according to the embodiment of the present invention.

The structure of the insulation spacer 31 is illustrated in FIGS. 20 and 21. As shown in FIG. 20, there is a pair of key grooves 31*a* and 31*b* at the absolutely opposite position to each other (at the angle of 180°). The key groove 31*a* (31*b*) and the key 25*b* (27*b*) of the guide bar 25 (27) also constitute the "key/key-groove structure" as above discussed. Thus the insulation spacers 31 may be installed according to a predetermined positioning similar to those of the conductive rings 29.

Further, as illustrated in FIGS. 1 and 3, a plurality of lead wires 33 are connected to the conductive rings 29. FIG. 1 also shows the state that the lead wires 33, which have been connected to the conductive ring 29, are also connected to the rotative part of an arbitrary instrument.

As above discussed, the conductive rings 29 and the insulation spacers 31 are alternately placed on top of each other according to the detachable structure. With this structure, for example, when there is any conduction or insulation defect (such that arbitrary one of the conductive rings 29 causes the conduction defect), this defective part can independently be replaced. Consequently, the troublesome overall replacement of assembly in spite of the defect at only one section thereof, which has been typical with the prior art, is no longer required.

As illustrated in FIG. 3, a bearing 43 is attached to a shaft 19*c* of the rotor shaft 19 via a wave washer 41. The rotor shaft 19 also accepts, on the opposite side of this bearing 43, a rotor base 45 made of insulating material, which is engaged with and fixed on the rotor shaft 19 by a screw 47. The outer periphery of the rotor base 45 has a bearing 49 attached thereto, and a stopper ring 51 prevents the drop-off of the bearing 49. With reference to the left hand end of the rotor base 45 of FIG. 3, there is a penetration hole 45*a* into which the screw 47 is penetrated. Further, the penetration hole 45*a* is surrounded by a pair of lead wire outlets 45*b*, 45*c*, out of which the lead wires 33 are drew.

Figure 22:
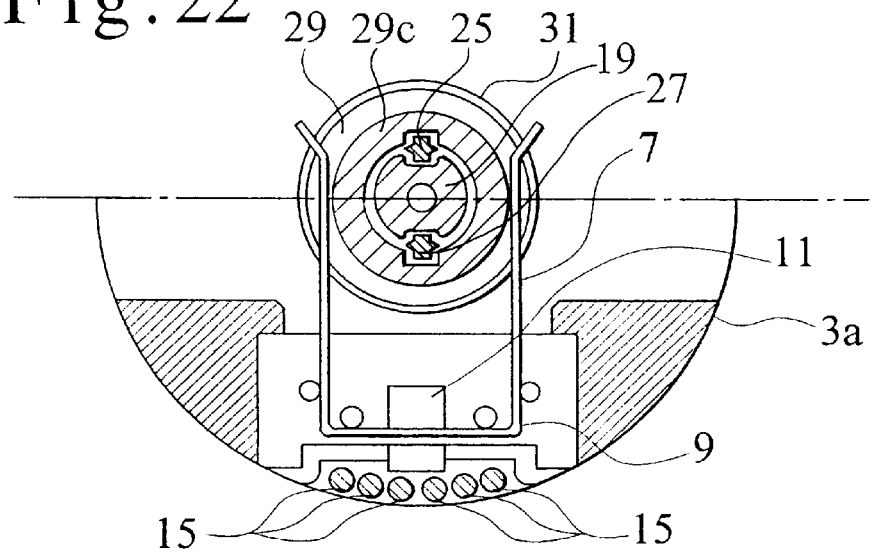
FIG. 22 is a sectional view showing structure of the brush and the adjacent section according to the embodiment of the present invention.

FIG. 22 is a sectional view showing a structure of the brush 7 and the adjacent section thereto. As is clear from FIG. 22, each end of the brush 7 is in contact with the outer periphery of the conductive ring 29 with a proper pressure applied thereto. This is true to the other brush 7 (not illustrated) positioned opposite to that of FIG. 22.

The function of the present invention will now be described.

Figure 23:
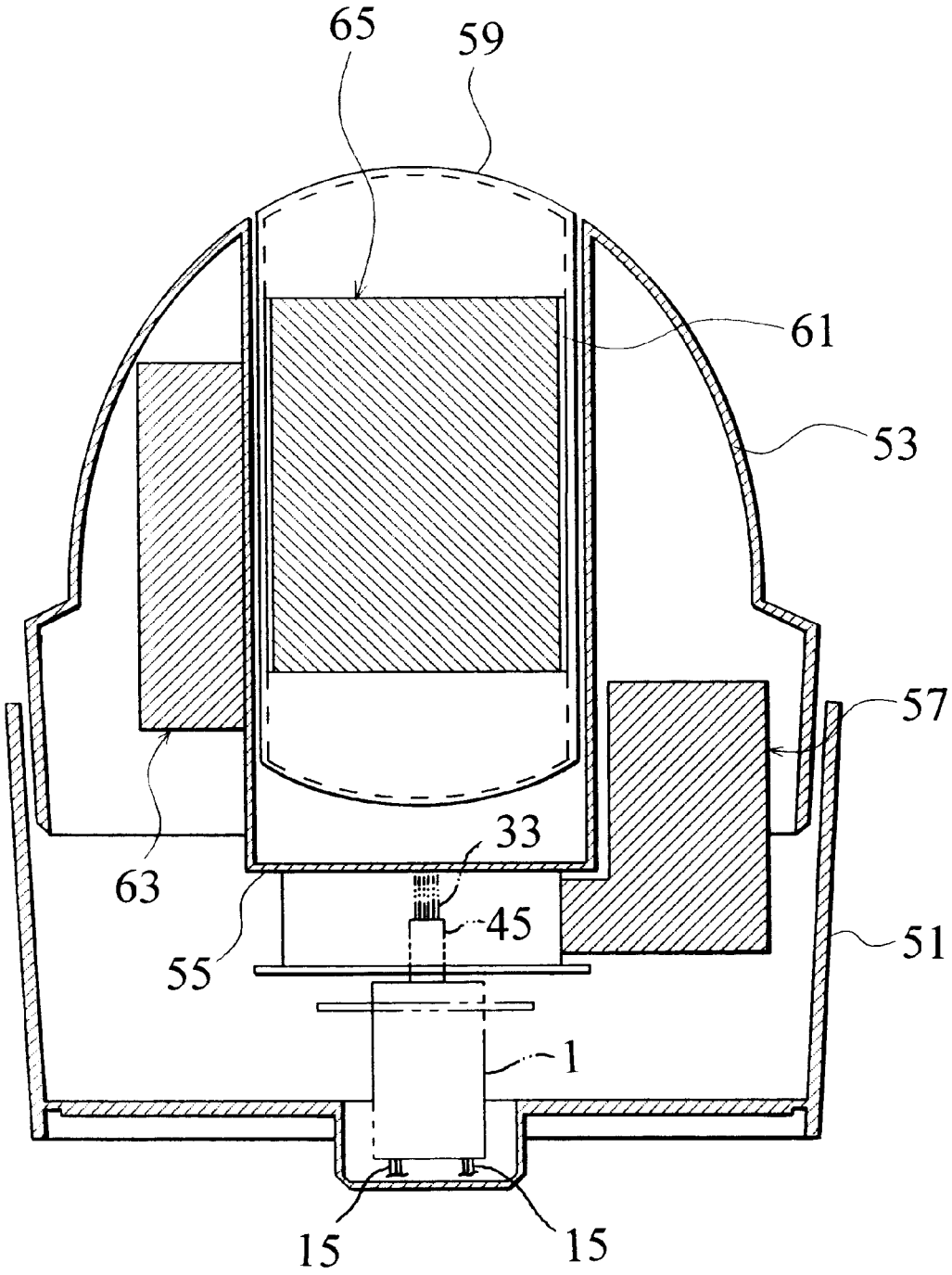
FIG. 23 is a sectional view according to the present invention in which the slip ring assembly is actually used.

First, FIG. 23 shows an example of function by using the slip ring assembly for an instrument according to the present invention. FIG. 23 is a sectional view of a security camera assembly, in which a panning case 53 (the movable side of the instrument) is provided on a basement case 51 (the fixed side of the instrument). The basement case 51 accommodates a pan-frame 55. The panning case 53 and the pan-frame 55 are attached to the basement case 51 to be rotative in the horizontal direction of FIG. 23. That is, the basement case 51 accommodates a pan-motor unit 57, and when this pan-motor unit 57 is driven, both the panning case 53 and the pan-frame 55 rotate in the horizontal direction of FIG. 23.

The panning case 53 has a tilting case 59, in which a tilt frame 61 is accommodated. The tilting case 59 and the tilt frame 61 are attached to the pan-frame 55 to be rotative in the vertical direction of FIG. 23. That is, the panning case 53 accommodates a tilt motor unit 63, and when this tilt motor unit 63 is driven, both the tilting case 59 and the tilt frame 61 rotate in the vertical direction of FIG. 23.

A security camera unit 65 is mounted on this tilt frame 61. Consequently, when the pan-motor unit 57 is driven, the security camera unit 65 rotates in the horizontal direction of FIG. 23, and when the tilt motor unit 63 is driven, the security camera unit 65 rotates in the vertical direction of FIG. 23.

The slip ring assembly according to the present invention is incorporated in the basement case 51, in a state that the case 1 of the slip ring assembly being secured to the basement case 51. The rotor base 45 protruding from the case 1 in the upward direction (in the case of FIG. 23) can rotate as a part of the rotor unit 17. A plurality of lead wires 33 drew out of the rotor base 45 are connected to the security camera unit 65. In such a state, when the security camera unit 65 rotates, there occurs no trouble since the rotor unit follows the rotation of the security camera unit 65. With this structure, although the case 1 or the fixed base unit 3 accommodated in the case 1 does not rotate, the rotor unit 17 installed in the fixed base unit 3 relatively rotates together with the rotation of the security camera unit 65.

The manufacturing steps of the slip ring assembly according to the present invention will now be described.

First, the guide bars 25, 27 are respectively attached to the grooves 21, 23 of the rotor shaft 19. Then, the conductive rings 29 and the insulation spacers 31 are alternately placed on top of each other on the outer periphery of the guide bars 25, 27. This constitutes the rotor unit 17.

Then the rotor unit 17 is inserted in a space between the fixed base element 3a and the other fixed base element 3*b*. Through the steps up to now, the assembly in which the rotor unit 17 and the fixed base unit 3 are integrated may be obtained. This assembly is incorporated in the case 1, and the necessary minor arrangements relating thereto are carried out. Thus, the complete slip ring assembly can be obtained.

The slip ring assembly according to the embodiment of the present invention has the following merits.

First, according to the present invention, the plurality of conductive rings 29 and the insulation spacers 31 are alternately placed on top of each other on the outer periphery of the rotor shaft 19 so that any of the rings 29 or the spacers 31 may be detached. Accordingly, if there is any conduction or insulation defect in any of these parts, it is sufficient to replace the only defective one of the conductive rings 29 or the insulation spacers 31 to a new one, thus the replacement of the whole unit, which is a typical trouble with the prior art, is no longer required. Therefore the duration of the slip ring assembly unit as a whole may be extended.

Further, according to the present invention, the pair of the guide bars 25, 27 are attached to the outer periphery of the rotor shaft 19, and the plurality of the conductive rings 29 and the insulation spacers 31 are engaged with the guide bars so that the alternate placement of the rings 29 and the spacers 31 are obtained on the outer periphery of the guide bars 25, 27. Therefore the piling process is significantly facilitated.

In regard to the plating for the rotor unit, while the plating in the prior art has been carried out in a complete state as a rotor unit after finishing of the insert molding and lathe working, the plating according to the present invention may be carried out in an independent state as the conductive ring 29. Therefore the large number of the conductive rings 29 may be soaked in the plating bath at one time in order to carry out the plating. Thus the cost for plating may significantly be reduced. Material having higher conductivity is desirable for plating, such as gold.

In regard to the fixed base unit, since the insert molding according to the prior art is not necessary, there is no possibility of distortion of brushes due to pressure of the insert molding, thus the correction of the brush, which has been required under the prior art, is no more required. Consequently, the production cost will remarkably be reduced.

Since neither the rotor unit nor the fixed base unit should be produced according to the conventional insert molding, use of the material covered with a high-temperature resistance material such as "Teflon" is not required, for the lead wire 15 connected to the brush 7, or the lead wire 33 connected to the conductive ring 29. The cost reduction will also be accomplished in this respect.

According to the prior art, when the slip ring assembly having a different number of electrodes is produced, it has been necessary to prepare the corresponding and special inserting molds for such a rotor unit as well as for such a fixed base unit. To the contrary, according to the present invention, since the insert molding is not required form the beginning, it is not necessary to prepare the various molds according to the various purposes, and the electrode plate 9 provided with the brush 7, the conductive rings 29, and the insulation spacers 31 can become the common parts in every kind of assembly, thus the unity of the parts can be accomplished. This also contributes to the cost reduction.

The present invention is not limited to the embodiment as described above.

Firstly, in regard to the guide mechanism of the rotor shaft, any protrusion elongated in the axial direction of the rotor shaft may be provided, and the plurality of the conductive rings and the insulation spacers may be placed on top of each other via the protrusion. There may be various arrangements, but in any case, it is sufficient as long as the conductive rings and the insulation spacers are guided in a state that each of the positions in the circumferential direction is determined.

Further, although the present embodiment has been described in the case of the security camera, this invention may also be applied to any instrument having a rotative body in which the electric power or signal, or the both, is supplied to such a rotative body.

What is claimed is:

1. A slip ring assembly comprising:

a fixed base unit comprising, a fixed base, a plurality of electrode plates detachably attached to a plurality of slits formed on said fixed base, and each of the electrode plates having a brush fixed thereon;

a rotor unit rotatably accommodated inside said fixed base unit comprising, a rotor shaft, and a plurality of conductive rings and insulation spacers alternately placed on top of each other on the outer periphery of said rotor shaft in a detachable state; and each of said conductive rings is positioned to correspond to the brush of each of the electrode plates.

2. The slip ring assembly as claimed in claim 1, wherein said rotor shaft is provided with a guide mechanism at the outer periphery thereof, said conductive rings and said insulation spacers being alternately placed on top of each other so that a circumferential position of each of said conductive rings and said insulation spacers is determined by said guide mechanism.

3. The slip ring assembly as claimed in claim 2, wherein said guide mechanism comprising, a pair of grooves elongated and extended in an axial direction of said rotor shaft, and a pair of guide bars respectively engaged with said pair of grooves, and a recessed portions formed on each of said conductive rings and said insulation spacers for engaging with said pair of guide bars.

4. The slip ring assembly as claimed in claim 3, wherein each of said pair of guide bars is provided with first protrusion which engages with each of the pair of grooves formed on said rotor shaft, and with second protrusion opposite to said first protrusion engaged with each of the recessed portions formed on each of said conductive rings and said insulation spacers.

5. The slip ring assembly as claimed in claim 1, wherein said brush is substantially formed in a shape of letter "U" and is nipped and fixed by folding a portion of said electrode plate.

6. The slip ring assembly as claimed in claim 5, wherein each end of said brush becomes wider in the outward direction.

7. The slip ring assembly as claimed in any one of claims 1 to 6, wherein said slip ring assembly is used for a security camera.

8. A slip ring assembly manufacturing method, comprising steps of:

alternately placing a plurality of conductive rings and insulation spacers on top of each other in a detachable state on an outer periphery of a rotor shaft, thereby forming a rotor unit;

detachably attaching a plurality of electrode plates each provided with a brush, respectively to a plurality of slits formed on a fixed base so that each brush may correspond to each of said conductive rings thereby forming a fixed base unit; and accommodating said rotor unit in said fixed base unit so that each brush may be in contact with each of said conductive rings.

9. The slip ring assembly manufacturing method as claimed in claim 8, further comprising a step of plating being applied to said conductive rings in advance.

* * * * *